US005328331A

United States Patent [19]

Bunker et al.

[11] Patent Number: 5,328,331

[45] Date of Patent: Jul. 12, 1994

[54] TURBINE AIRFOIL WITH DOUBLE SHELL OUTER WALL

[75] Inventors: Ronald S. Bunker, Cincinnati; Thomas T. Wallace, Maineville, both of Ohio

[73] Assignee: General Electric Company, Cincinnati, Ohio

[21] Appl. No.: 82,114

[22] Filed: Jun. 28, 1993

[51] Int. Cl.[5] ..... F01D 5/18

[52] U.S. Cl. ..... 416/96 R; 416/97 R; 416/233; 415/115; 415/116

[58] Field of Search ..... 415/115, 116; 416/96 R, 416/96 A, 97 R, 233

[56] References Cited

U.S. PATENT DOCUMENTS

| | | | |
|---|---|---|---|
| 3,540,810 | 11/1970 | Kercher | 416/96 A |
| 3,726,604 | 4/1973 | Helms et al. | 415/115 |
| 3,806,276 | 4/1974 | Aspinwall | 416/97 R |
| 3,902,820 | 10/1975 | Amos | 416/97 R |
| 3,930,748 | 1/1976 | Redman et al. . | |
| 4,064,300 | 12/1977 | Bhangu . | |
| 4,086,021 | 4/1978 | Stenfors | 415/115 |
| 4,105,364 | 8/1978 | Dodd | 416/97 R |
| 4,118,146 | 10/1978 | Dierberger | 416/97 A |
| 4,183,716 | 1/1980 | Takahara et al. | 416/96 A |
| 4,236,870 | 12/1980 | Hucul et al. | 415/115 X |
| 4,270,883 | 6/1981 | Corrigan | 416/97 A |
| 4,403,917 | 9/1983 | Laffitte et al. | 415/115 |
| 4,515,523 | 5/1985 | North et al. | 415/115 |
| 4,695,247 | 9/1987 | Enzaki et al. . | |
| 4,697,985 | 10/1987 | Suzuki | 415/115 X |
| 4,790,721 | 12/1988 | Morris et al. | 416/96 A |
| 4,946,346 | 8/1990 | Ito | 415/115 |
| 5,030,060 | 7/1991 | Liang . | |
| 5,073,086 | 12/1991 | Cooper | 416/96 R |

*Primary Examiner*—Edward K. Look
*Assistant Examiner*—Michael S. Lee
*Attorney, Agent, or Firm*—Jerome C. Squillaro; Nathan D. Herkamp

[57] ABSTRACT

A coolable airfoil for use in gas turbine engine component such as a turbine blade or vane is provided with an integrally formed double shell outer wall surrounding at least one radially extending cavity. The inner and the outer shells are integrally formed of the same material together with tying elements which space apart the shells and mechanically and thermally tie the shells together. The present invention contemplates tying elements including pedestals, rods, and/or continuous or intermittent ribs. Impingement cooling means for the outer shell, in the form of impingement cooling holes, is provided on the inner shell to direct the coolant in impingement jet arrays against the outer shell, thereby, cooling the outer shell.

12 Claims, 5 Drawing Sheets

TURBINE AIRFOIL WITH DOUBLE SHELL OUTER WALL

The Government has rights in this invention pursuant to Contract No. F33615-90-C-2006 awarded by the Department of the Air Force.

BACKGROUND OF THE INVENTION

1. Field of the Invention

This invention relates to cooling of turbine airfoils and more particularly to hollow turbine vanes having double shell airfoil walls.

2. Description of Related Art

It is well known to cool parts using heat transfer across walls having hot and cold surfaces by flowing a cooling fluid in contact with the cold surface to remove the heat transferred across from the hot surface. Among the various cooling techniques presently used are convection, impingement and film cooling as well as radiation. These cooling techniques have been used to cool gas turbine engine hot section components such as turbine vanes and blades. A great many high pressure turbine (HPT) vanes, and particularly the high pressure turbine inlet guide vane, also known as the combustor nozzle guide vane, utilize some form of a cooled hollow airfoil. An airfoil typically has a hollow body section which includes a leading edge having a leading edge wall followed by a pressure side wall and a suction side wall which form a substantial part of the outer wall which includes the hot wetted surface on the outside of the walls. The pressure and suction side walls typically converge to form a trailing edge.

Typically, a vane having a hollow airfoil is cooled using two main cavities, one with coolant air fed from an inboard radial location and the other with coolant air fed from an outboard location. These cavities contain impingement inserts which serve to receive cooling air and direct the coolant in impingement jet arrays against the outer wall of the airfoil's leading edge and pressure and suction side walls to transfer energy from the walls to the fluid, thereby, cooling the wall. These inserts are positioned by inward protrusions from the outer wall of the airfoil. These protrusions or positioning dimples are not connected to the inserts and provide the barest of contact between the insert and the airfoil wall (no intimate material contact at all). The high pressure of the cooling air in the cavity or insert is greater than that of the air on the outside of the airfoil causing a great deal of stress across the airfoil wall. One of the most frequent distress and life limiting mechanisms in conventional and particularly single wall vane airfoils is suction side panel blowout. This is a creep rupture phenomenon caused by stresses due to bending and temperature. Therefore an airfoil design is needed that will reduce these stresses and prolong the creep rupture life of the airfoil and turbine vane or blade.

Disclosed in U.S. Pat. No. 3,806,276 entitled "Cooled Turbine Blade", by Aspinwall, is a turbine blade having an insert or a liner made of a high conductivity metal such as cuprous nickel and which is bonded to a point on the radially extending ribs along the outer wall of the blade. The liner, because it is made of a high conductivity metal such as cuprous nickel has low strength and must be considered as dead load (non load/stress carrying). Therefore, it adds no significant stiffness to the airfoil and is not very capable of resisting bending moments due to the pressure differential across the airfoil outer wall. Another drawback is the bond points because they are inherently weaker than the surrounding material and therefore subject to failure under loads due to pressure differential induced bending moments and centrifugal forces in the case of rotating blades. Furthermore, since the insert is dead load, the outer wall of the blade will have to be thickened to carry the additional mass due to the centrifugal load which a turbine blade is subjected to. This will effectively increase the temperature differential $\Delta T$ across the outer wall thereby raising the peak surface temp and the thermal stresses.

Such vanes also utilize other common design features for cooling such as film cooling and a trailing edge slot and have typically been manufactured from materials with thermal conductivities in the range of 10 to 15 BTU/hr/ft/° F. A primary goal of turbine design is improved efficiency, and a key role in this is the reduction of component cooling flows. With the development of intermetallic materials, thermal conductivities on the order of 40 BTU/hr/ft/° F. or even greater may be realized. Fabrication of intermetallic components by means other than casting or welding allows the design of more complex components with new features.

Turbine vane cooling requires a great deal of cooling fluid flow which typically requires the use of power and is therefore generally looked upon as a fuel efficiency and power penalty in the gas turbine industry. The present invention provides improved turbine vane cooling and engine efficiency.

SUMMARY OF THE INVENTION

According to the present invention a radially extending airfoil having a hollow body section including a leading edge section and a pressure side and a suction side is provided with an integrally formed double shell outer wall surrounding at least one radially extending cavity. The inner and the outer shells are integrally formed of the same material together with tying elements which space apart the shells and mechanically and thermally tie the shells together. The present invention contemplates tying elements including pedestals, rods, and/or continuous or intermittent ribs. Impingement cooling means for the outer shell, in the form of impingement cooling holes, is provided on the inner shell to direct the coolant in impingement jet arrays against the outer shell for cooling the outer shell.

One embodiment of the present invention provides film cooling means for the outer shell and the use of trailing edge cooling means such as cooling slots. Additional features and embodiments contemplated by the present invention include inner and outer shells of equal and unequal thicknesses.

ADVANTAGES

The present invention provides a gas turbine engine coolable airfoil with a double shell outer wall which is able to more effectively utilize essentially twice as much surface area for heat transfer internally as compared to a single shell wall. The use of two shells allows the inner shell to be maintained at a lower temperature than the outer shell, while the outer shell is maintained at a similar temperature level to that of the single shell design. The resulting double shell wall bulk temperature is much lower than that of a single shell wall. This results in a significant reduction in coolant requirements and thus improved turbine efficiency. The integrally formed and connected double shell wall design more efficiently resists bending loads due to the pressure differential across the wall particularly at elevated temperatures. This leads to increased creep rupture life for airfoil turbine walls. The present invention can be used to save weight, or, alternately, increase creep/rupture margin. The invention can also be used to reduce the amount of coolant flow required which improves engine fuel efficiency. Additional ribs or tie rods may be utilized attaching the suction side of the wall to the pressure side of the wall to limit the bending stresses to an even greater degree.

The foregoing, and other features and advantages of the present invention, will become more apparent in the light of the following description and accompanying drawings.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
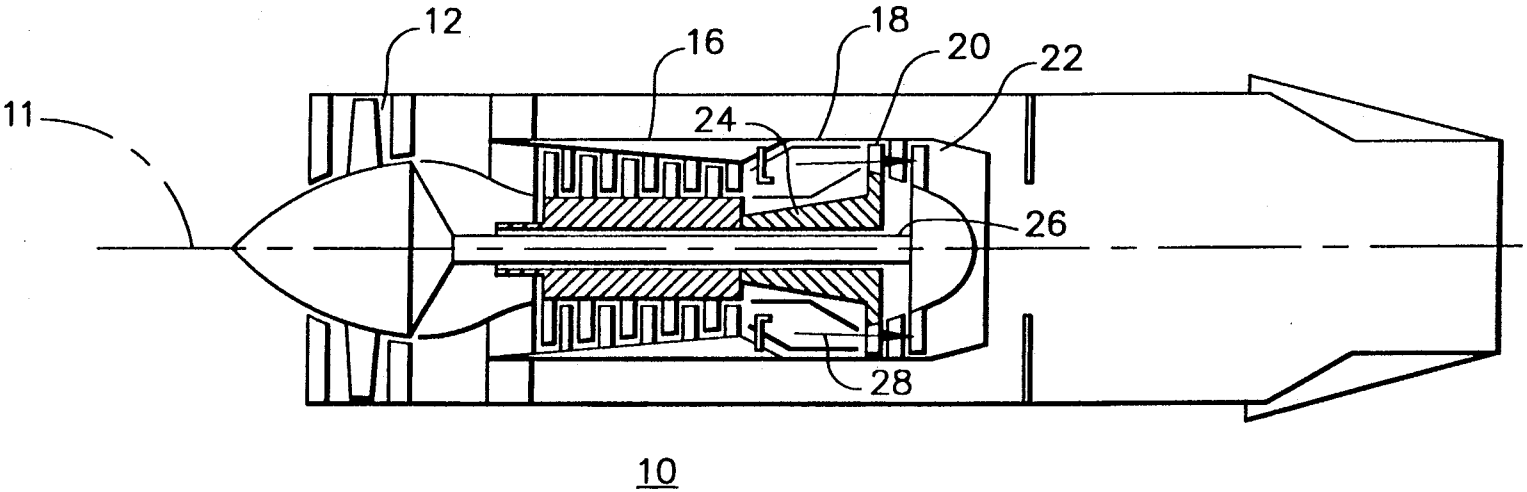
FIG. 1 is a cross-sectional view of a gas turbine engine having air cooled turbine vane and blade airfoils with double shell walls in accordance with the present invention.

Illustrated in FIG. 1 is a gas turbine engine 10 circumferentially disposed about an engine centerline 11 and having in serial flow relationship a fan section indicated by a fan section 12, a high pressure compressor 16, a combustion section 18, a high pressure turbine 20, and a low pressure turbine 22. The combustion section 18, high pressure turbine 20, and low pressure turbine 22 are often referred to as the hot section of the engine 10. A high pressure rotor shaft 24 connects, in driving relationship, the high pressure turbine 20 to the high pressure compressor 16 and a low pressure rotor shaft 26 drivingly connects the low pressure turbine 22 to the fan section 12. Fuel is burned in the combustion section 18 producing a very hot gas flow 28 which is directed through the high pressure and low pressure turbines 20 and 22 respectively to power the engine 10.

Figure 2:
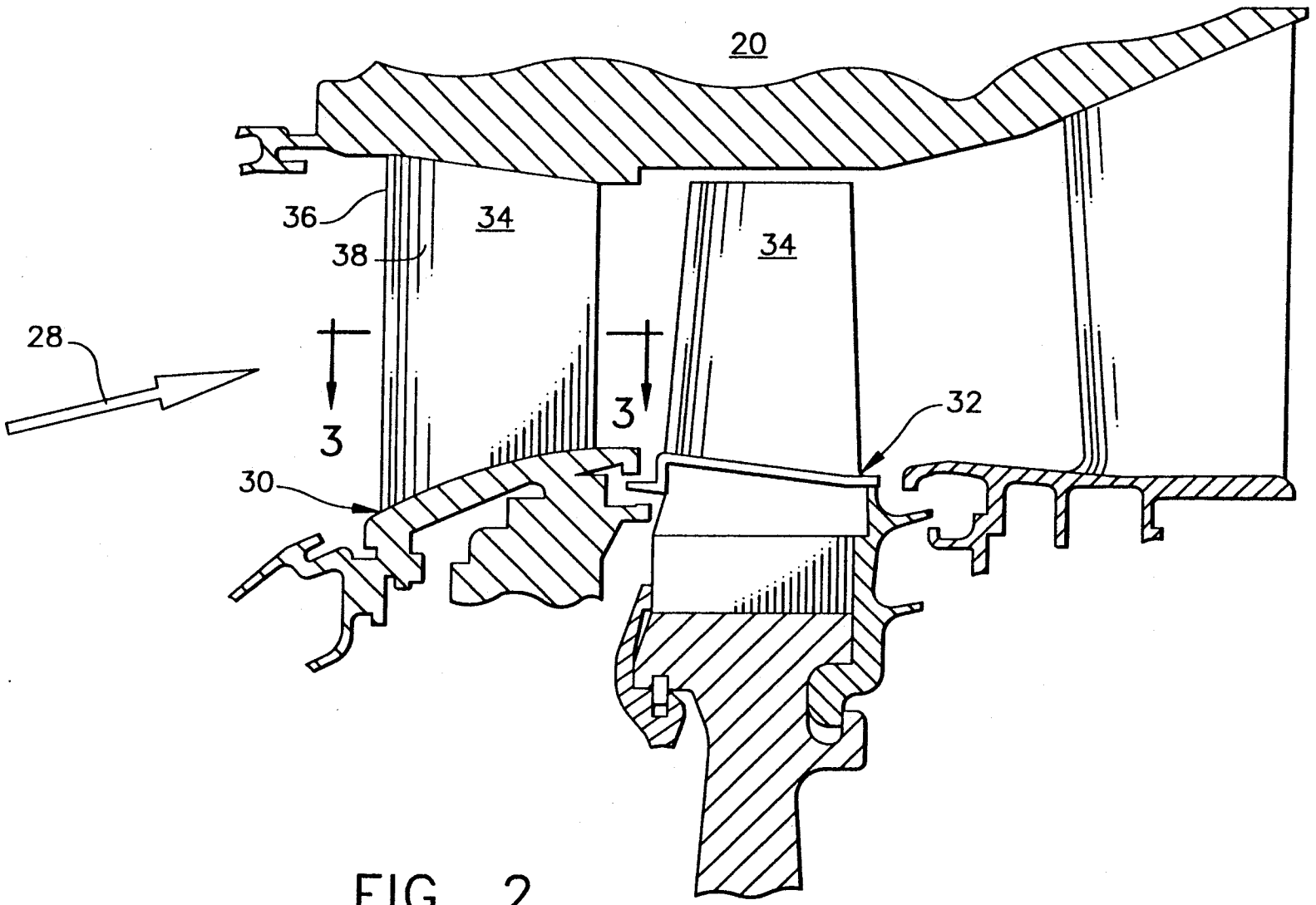
FIG. 2 is an enlarged cross-sectional view of a portion of the turbine illustrating the air cooled turbine vane and blade in FIG. 1.

FIG. 2 more particularly illustrates the high pressure turbine 20 having a turbine vane 30 and a turbine blade 32. An airfoil 34 constructed in accordance with the present invention may be used for either or both the turbine vane 30 and the turbine blade 32. The airfoil 34 has an outer wall 36 with a hot wetted surface 38 which is exposed to the hot gas flow 28. Turbine vanes 30, and in many cases turbine blades 32, are often cooled by air routed from the fan or one or more stages of the compressors (through a platform 41 of the turbine vane 30). The present invention provides an internal cooling scheme for airfoils 34.

Figure 3:
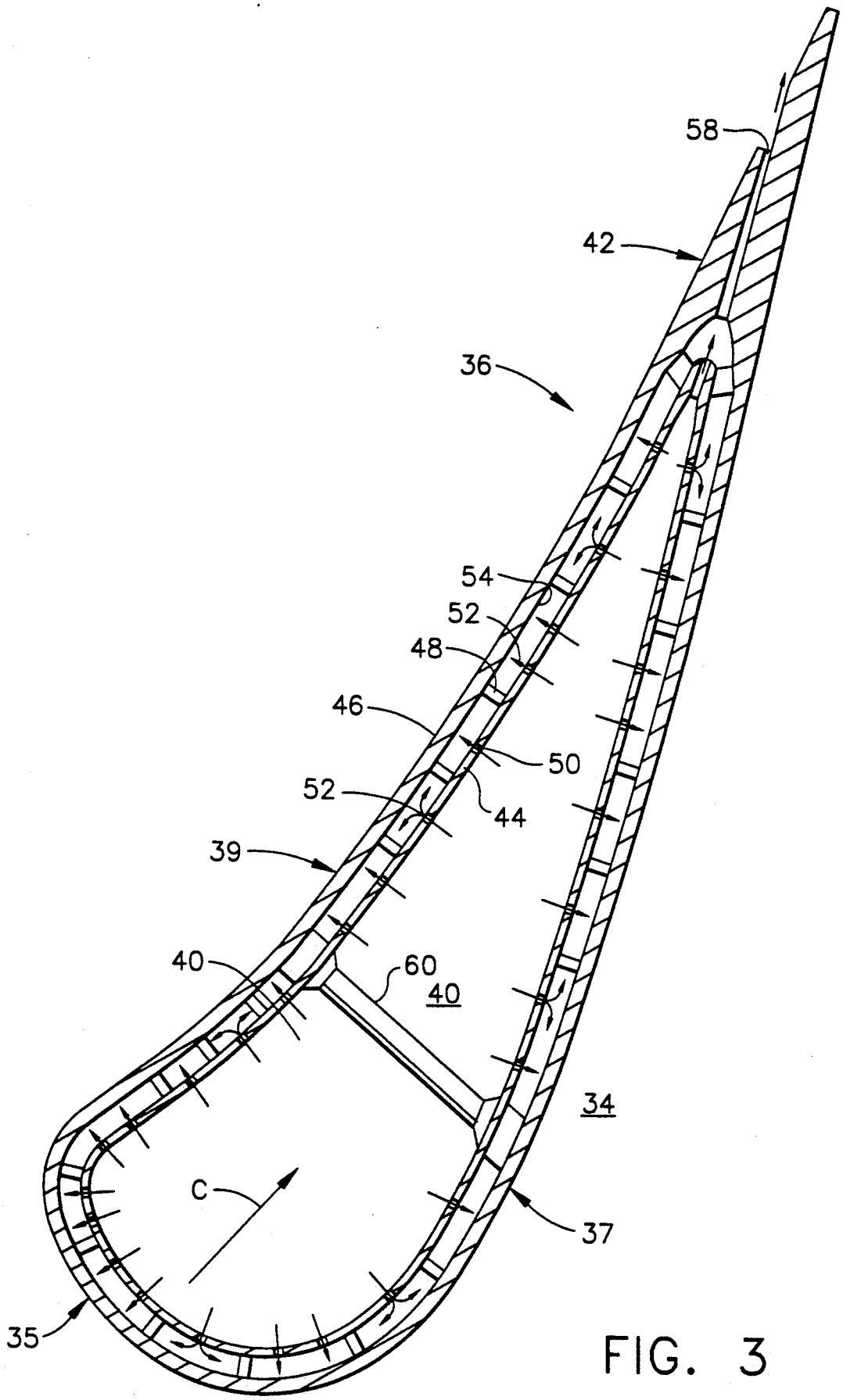
FIG. 3 is a cross-sectional view of the turbine vane airfoil taken through 3—3 in FIG. 2.
Figure 4:
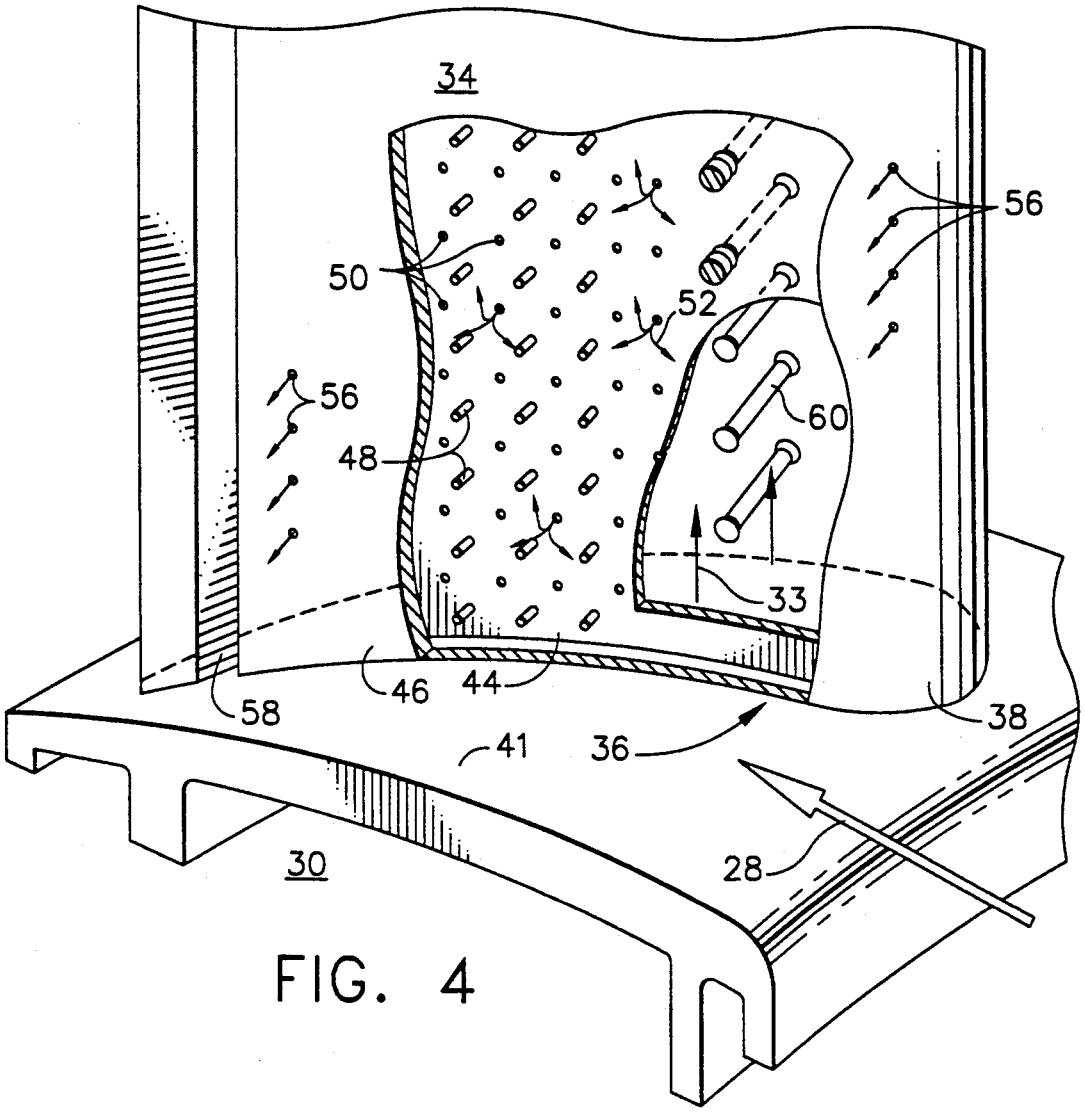
FIG. 4 is an enlarged cut-away perspective view illustrating a first embodiment of the tying elements and other features of the turbine vane illustrated in FIG. 2.
Figure 5:
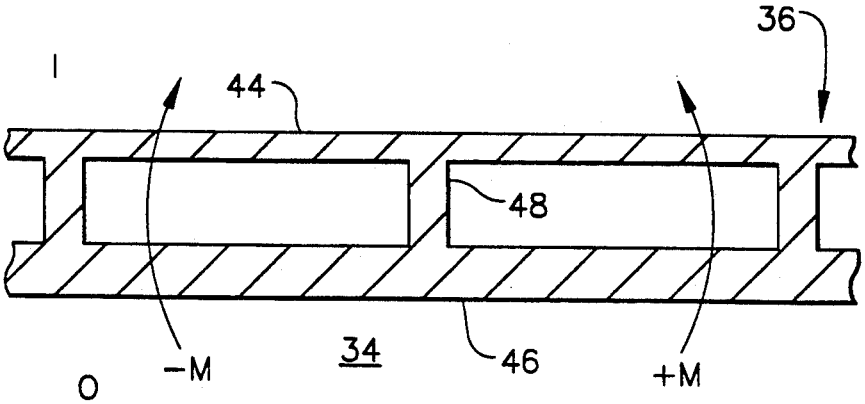
FIG. 5 is an enlarged cross-sectional view of a portion of the turbine vane airfoil in FIG. 3.

Illustrated in FIGS. 3 and 4 is the airfoil 34 which includes a leading edge section 35, a suction side 37, and a pressure side 39, and terminates in a trailing edge 42. The present invention provides the airfoil 34 with an outer wall 36 which surrounds at least one radially extending cavity 40 which is operably constructed to receive cooling air 33 through the platform 41. The outer double shell outer wall 36 extends generally in the chordwise direction C from the leading edge section 35 through and between the suction side 37 and the pressure side 39. According to the present invention the outer wall 36 is onepiece, as illustrated in FIG. 5, having an integrally formed double shell construction including an inner shell 44 spaced apart from an outer shell 46 with mechanically and thermally tying elements 48 which are integrally formed with and disposed between the inner and outer shells.

The exemplary embodiment illustrated in FIG. 3 provides a double shell construction of the outer wall 36 which only extends chordwise C through a portion of the airfoil 34 that does not generally include the trailing edge 42. This is not to be construed as a limitation of the invention and an inner shell 44 could be constructed so as to extend into the trailing edge as well.

The double shell design, particularly when it is constructed of a preferably high thermal conductivity material for example an intermetallic such as a nickel aluminide, permits a substantial amount of the external heat load to be transferred by conduction from the outer shell 46 to the inner shell 44 through the connecting pedestals or tying elements 48. An impingement cooling means, in the form of impingement cooling holes 50 through the inner shell 44, is provided for cooling the outer shell 46. The impingement cooling holes 50 direct the coolant in an array of impingement jets 52 against an inner surface 54 of the outer shell 46, thereby, cooling the outer shell. Heat is removed from the inner shell 44 by convection in the impingement cooling holes 50 and by convection due to the post-impingement flow between the inner shell 44 and the outer shell 46. The tying elements 48 also serve to reduce the temperature gradient from the inner shell 44 to the outer shell 46 which helps reduce thermal stresses.

The following nomenclature is used below. A subscript 2 indicates characteristics and parameters associated with the inner shell 44 and a subscript 1 indicates characteristics and parameters associated with the outer shell 46 of the present invention. Characteristics and parameters not subscripted are associated with a reference single shell outer wall of the prior art. A conventional airfoil provided with an insert and impingement cooling holes in the insert has a single shell outer wall which transmits an external heat load to the outer wetted surface through the outer wall and into the fluid. The impingement heat transfer coefficient is h, and the inner surface-to-fluid temperature potential is $\Delta T$. For an internal surface area of A, the heat flux to the fluid is $Q=hA\Delta T$. The inner surface of the outer shell still experiences an impingement heat transfer level characterized by an impingement heat transfer coefficient h, but at a slightly reduced temperature potential $\Delta T_1$. The outer surface of the inner shell experiences a heat transfer coefficient $h_2$, which may be of a magnitude nearly as great as h depending upon geometric and fluid dynamic parameters. Due to conduction of energy through the pedestals, the temperature potential $\Delta T2$ from the inner shell to the fluid is still significant. The sum of these heat fluxes, $$Q=Q_1+Q_2=hA_1\Delta T_1+h_2A_2\Delta T_2$$

is greater than that of the single shell design, resulting in an adjusted external heat load.

Mechanically, the double shell design is a more efficient design. Referring to FIG. 5, for constant volume of material, the double shell has a higher moment of inertia in the bending plane shown. An aft portion of the outer wall 36 in the suction side 37 of vane airfoil is subjected to a high temperature and significant pressure loading from the inside I to outside O of the vane. This causes bending moments ±M which is resisted by the double shell wall 36 because it has a higher moment of inertia in the bending plane. One of the most frequent distress and life limiting mechanisms in the single wall vane is suction side panel blowout, which is a creep rupture phenomenon caused by stresses due to bending and temperature. The higher moments of inertia with the double shell design will reduce the mechanical stress, and therefore, prolong the creep rupture life.

Additional embodiments of the present invention provide optional features such as a conventional film cooling means for the outer shell 46 exemplified in the FIG. 4 by film cooling holes 56. Another such feature is a trailing edge cooling means such as cooling slots 58 illustrated in FIGS. 3 and 4. Alternative embodiments contemplated by the present invention also include providing inner and outer shells of equal and unequal thicknesses in order to balance mechanical and thermal stress requirements.

Figure 6:
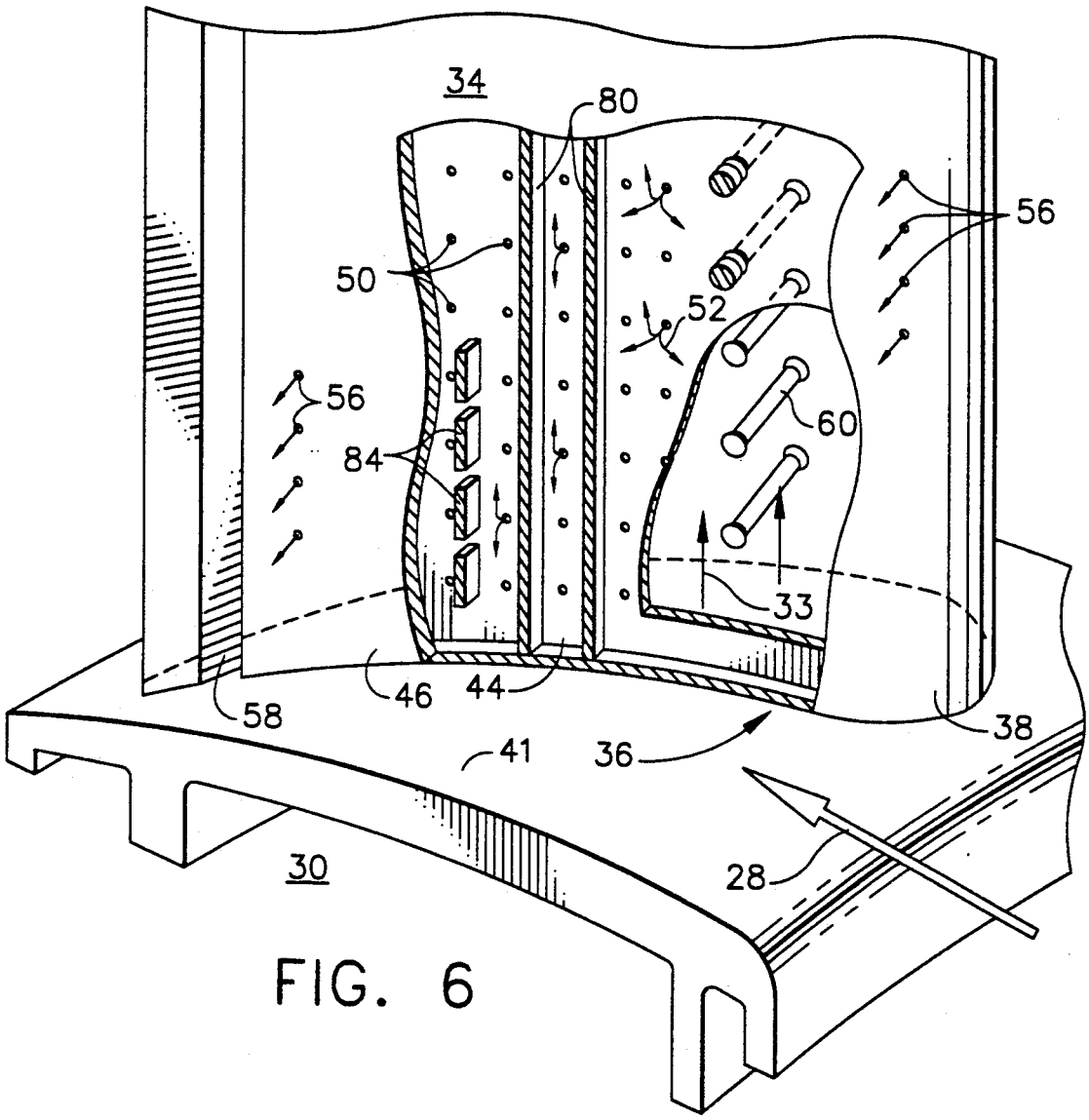
FIG. 6 is an enlarged cut-away perspective view illustrating a second embodiment of the tying elements of the turbine vane illustrated in FIG. 2.

Another optional feature illustrated in the exemplary embodiment of FIGS. 3, 4 and 6 is a plurality of mechanical tie members 60, shown in but not limited to the form of rods, which are utilized to mechanically attach the outer wall 36 along the suction side 37 of the airfoil 34 to the outer wall along the pressure side 39 of the airfoil to further limit the bending stresses in the outer wall. Another drawback to the prior art is that the use of such tie members across the cavity 40 is not an effective means of controlling stresses in the single wall design of the prior art because the inserts are not mechanically well connected to the vane walls. Alternatively the use of such tie members would require multiple inserts on either side of such tie members that may not otherwise be necessary or feasible.

FIG. 6 illustrates another embodiment with further optional features such as discrete continuous ribs 80 and intermittent ribs 84 which may be used depending upon local flow requirements rather than the pedestal type tying elements 48 illustrated in FIG. 4. The continuous ribs 80 rather than pedestals allows the compartmentalization of impingement flow in specific regions to locally tailor the cooling flow. The continuous ribs 80 also provide a means to help tailor the film blowing rates through the film cooling holes 56 which improves film effectiveness for cooling the external hot surface 38.

While the preferred and an alternate embodiment of the present invention has been described fully in order to explain its principles, it is understood that various modifications or alterations may be made to the preferred embodiment without departing from the scope of the invention as set forth in the appended claims.

We claim:

1. A coolable airfoil for use and exposure in a hot gas flow of a gas turbine engine, said coolable airfoil comprising:

a hollow body section including a chordwise extending leading edge section operably connected to a pressure side and a suction side of the airfoil, a one-piece integrally formed double shell outer wall surrounding at least one radially extending cavity and extending chordwise through said leading edge section, pressure side, and suction side, said outer wall comprising an inner shell and an outer shell integrally formed with tying elements therebetween of the same material as said shells, and said tying elements operably constructed to space apart said shells and mechanically and thermally tie said shells together.

2. A coolable airfoil as claimed in claim 1 further comprising impingement cooling holes in said inner shell.

3. A coolable airfoil as claimed in claim 2 wherein said tying elements are pedestals.

4. A coolable airfoil as claimed in claim 2 wherein said tying elements are ribs.

5. A coolable airfoil as claimed in claim 2 further comprising tie elements between spaced apart portions of said inner shell.

6. A coolable airfoil as claimed in claim 2 wherein said an inner shell and an outer shell are of unequal thicknesses.

7. A turbine vane comprising;

an inner platform, an outer platform radially spaced apart from said inner platform, a coolable airfoil radially extending between said platforms and comprising:

a hollow body section including a chordwise extending leading edge section operably connected to a pressure side and a suction side of the airfoil, a one-piece integrally formed double shell outer wall surrounding at least one radially extending cavity and extending chordwise through said leading edge section, pressure side, and suction side, said outer wall comprising an inner shell and an outer shell integrally formed with tying elements therebetween of the same material as said shells, and said tying elements operably constructed to space apart said shells and mechanically and thermally tie said shells together.

8. A turbine vane as claimed in claims 7 further comprising impingement cooling holes in said inner shell.

9. A turbine vane as claimed in claim 8 wherein said tying elements are pedestals.

10. A turbine vane as claimed in claim 8 wherein said tying elements are ribs.

11. A turbine vane as claimed in claim 8 further comprising tie elements between spaced apart portions of said inner shell.

12. A turbine vane as claimed in claim 8 wherein said an inner shell and an outer shell are of unequal thicknesses.

* * * * *